US011262667B2

(12) United States Patent
Takatsuna et al.

(10) Patent No.: US 11,262,667 B2
(45) Date of Patent: Mar. 1, 2022

(54) MAGNETIC TONER

(71) Applicant: KYOCERA Document Solutions Inc., Osaka (JP)

(72) Inventors: Toru Takatsuna, Osaka (JP); Sho Sumioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 66 days.

(21) Appl. No.: 16/984,193

(22) Filed: Aug. 4, 2020

(65) Prior Publication Data

US 2021/0041798 A1 Feb. 11, 2021

(30) Foreign Application Priority Data

Aug. 6, 2019 (JP) ..... JP2019-144559

(51) Int. Cl.
*G03G 9/08* (2006.01)
*G03G 9/097* (2006.01)
(Continued)

(52) U.S. Cl.
CPC ..... *G03G 9/09775* (2013.01); *G03G 9/083* (2013.01); *G03G 9/0819* (2013.01); *G03G 9/08711* (2013.01)

(58) Field of Classification Search
CPC . G03G 9/09775; G03G 9/08711; G03G 9/083
See application file for complete search history.

(56) References Cited

U.S. PATENT DOCUMENTS

2002/0045120 A1* 4/2002 Yoshikawa ..... G03G 9/08795 430/108.5

FOREIGN PATENT DOCUMENTS

JP 2015-225318 A 12/2015

* cited by examiner

*Primary Examiner* — Mark A Chapman
(74) *Attorney, Agent, or Firm* — Studebaker & Brackett PC

(57) ABSTRACT

A magnetic toner includes toner particles. The toner particles each include a toner mother particle and an external additive attached to a surface of the toner mother particle. The toner mother particles contain a binder resin and a magnetic powder. The external additive includes resin particles as external additive particles. The resin particles have a blocking rate of no greater than 40% by mass. The resin particles have a number average primary particle diameter of at least 40 nm and no greater than 120 nm. A resin constituting the resin particles is a vinyl resin including repeating units represented by general formulas (1) and (2), and a repeating unit derived from a sulfo group-containing vinyl compound. The content of the repeating unit derived from the sulfo group-containing vinyl compound in the vinyl resin is at least 0.1 mol % and no greater than 3.5 mol %
(Continued)

(1)
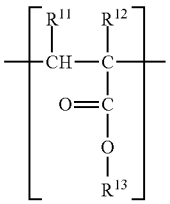
(2)
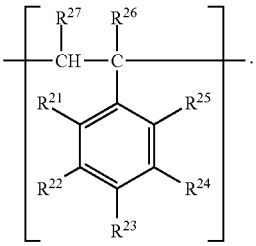
9 Claims, 1 Drawing Sheet
(51) Int. Cl.
*G03G 9/087* (2006.01)
*G03G 9/083* (2006.01)

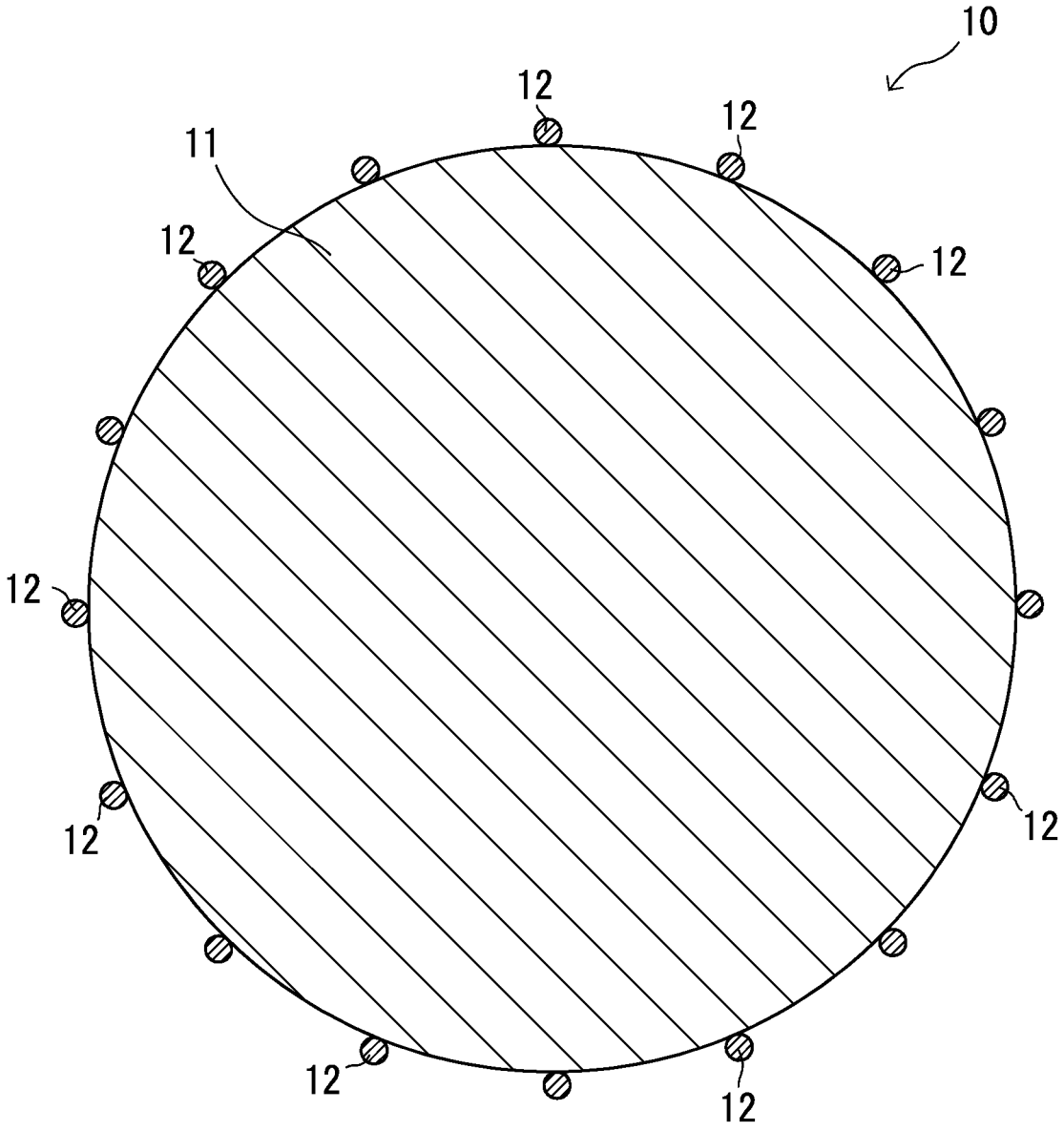
10
11
12
12
12
12
12
12
12
12
12
12

MAGNETIC TONER

INCORPORATION BY REFERENCE

The present application claims priority under 35 U.S.C. § 119 to Japanese Patent Application No. 2019-144559, filed on Aug. 6, 2019. The contents of this application are incorporated herein by reference in their entirety.

BACKGROUND

The present disclosure relates to a magnetic toner.

In order to obtain a magnetic toner having excellent durability, it has been proposed to externally add silica particles having a number average primary particle diameter of at least 30 nm and no greater than 200 nm to surfaces of toner mother particles containing a magnetic material.

SUMMARY

A magnetic toner according to the present disclosure includes toner particles. The toner particles each include a toner mother particle and an external additive attached to a surface of the toner mother particle. The toner mother particles contain a binder resin and a magnetic powder. The external additive includes resin particles as external additive particles. A blocking rate of the resin particles after pressurization at a temperature of 160° C. and a pressure of 0.1 kgf/mm$^2$ for 5 minutes is no greater than 40% by mass as measured using a mesh having an opening of 75 μm. The resin particles have a number average primary particle diameter of at least 40 nm and no greater than 120 nm. A resin constituting the resin particles is a vinyl resin including a repeating unit represented by general formula (1) shown below, a repeating unit represented by general formula (2) shown below, and a repeating unit derived from a sulfo group-containing vinyl compound. A content of repeating unit derived from the sulfo group-containing vinyl compound in the vinyl resin is at least 0.1 mol % and no greater than 3.5 mol % relative to all repeating units in the vinyl resin.

(1)

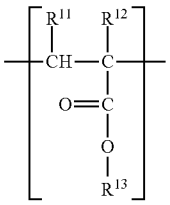

In general formula (1), $R^{11}$ and $R^{12}$ each represent, independently of each other, a hydrogen atom, a halogen atom, or an alkyl group having a carbon number of at least 1 and no greater than 6, and $R^{13}$ represents an alkyl group having a carbon number of at least 1 and no greater than 6.

(2)

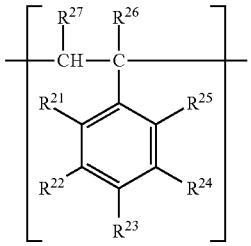

In general formula (2), $R^{21}$, $R^{22}$, $R^{23}$, $R^{24}$ and $R^{25}$ each represent, independently of one another, a hydrogen atom, a halogen atom, a hydroxy group, or an alkyl group having a carbon number of at least 1 and no greater than 6, and $R^{26}$ and $R^{27}$ each represent, independently of each other, a hydrogen atom, a halogen atom, or an alkyl group having a carbon number of at least 1 and no greater than 6.

BRIEF DESCRIPTION OF THE DRAWING

FIGURE is a diagram illustrating an example of a cross-sectional structure of a toner particle included in a magnetic toner according to an embodiment of the present disclosure.

DETAILED DESCRIPTION

The following describes a preferred embodiment of the present disclosure. First, terms used herein will be described. A toner is a collection (for example, a powder) of toner particles. An external additive is a collection (for example, a powder) of external additive particles. A magnetic powder is a collection (for example, a powder) of magnetic particles. Evaluation results (for example values indicating a shape and values indicating properties) for a powder (specific examples include a powder of toner particles, a powder of external additive particles, and a powder of magnetic particles) are each a number average of values measured with respect to a suitable number of particles selected from the powder, unless otherwise stated.

A measured value of a volume median diameter ($D_{50}$) of a powder (more specifically, a powder of particles) is a median diameter measured using a laser diffraction/scattering particle size distribution analyzer ("LA-950" product of HORIBA, Ltd.), unless otherwise stated. A number average primary particle diameter of a powder is a number average value of equivalent circle diameters of 100 primary particles of the powder (Heywood diameters: diameters of circles having the same areas as projected areas of the respective primary particles) measured using a scanning electron microscope ("JSM-7401F", product of JEOL Ltd.) and image analysis software ("WinROOF", product of MITANI Corp.), unless otherwise stated. Note that a timer average primary particle diameter of particles refers to a number average primary particle diameter of particles of a powder (number average primary particle diameter of the powder), unless otherwise stated.

A level of chargeability refers to a level of susceptibility to triboelectric charging, unless otherwise stated. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by the Imaging Society of Japan. An amount of charge of the measurement target is measured before and after triboelectric charging using for example a compact draw-off charge measurement system ("MODEL 212HS", product of TREK, Inc.). A measurement target having a larger change in amount of charge between before and after the triboelectric charging has stronger chargeability.

A "main component" of a material refers to a component contained the most in the material in terms of mass, unless otherwise stated.

An "alkyl group having a carbon number of at least 1 and no greater than 6" as used herein is an unsubstituted straight chain or branched chain alkyl group. Examples of the alkyl group having a carbon number of at least 1 and no greater than 6 include a methyl group, an ethyl group, an n-propyl group, an isopropyl group, an n-butyl group, an s-butyl group, a t-butyl group, an n-pentyl group, an isopentyl group, a neopentyl group, and an n-hexyl group.

In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. The term "(meth)acryl" is used herein as a generic term for both acryl and methacryl. Also, the term "(meth)acrylonitrile" is used herein as a generic term for both acrylonitrile and methacrylonitrile.

A "vinyl compound" is a compound having a vinyl group ($CH_2$═CH—) or a substituted vinyl group in which hydrogen is replaced (specific examples include ethylene, propylene, butadiene, vinyl chloride, (meth)acrylic acid, methyl (meth)acrylate, (meth)acrylonitrile, and styrene). The vinyl compound can be formed into a vinyl resin, which is a polymer of the vinyl compound, by addition polymerization through carbon-to-carbon double bond (C═C) included in the vinyl group or the like.

A "sulfo group-containing vinyl compound" is a vinyl compound having a sulfo group or a sulfonate group. Examples of a counter cation constituting the sulfonate group include monovalent cations (specific examples include a sodium ion, a potassium ion, and a lithium ion).

A resin constituting resin particles may be simply referred to below as a "constituent resin". A "cross-linked resin" refers to a resin having a cross-linked structure. A "cross-linked resin particle" refers to a resin particle of which the constituent resin is a cross-linked resin. A "resin base" refers to an untreated resin particle (for example, a resin particle not having a surfactant attached thereto). A "cross-linked resin base" refers to an untreated cross-linked resin particle (for example, a cross-linked resin particle not having a surfactant attached thereto).

Herein, the resin base and the resin base having a surfactant attached thereto may be referred to as a "resin particle". Similarly, the cross-linked resin base and the cross-linked resin base having a surfactant attached thereto may be referred to as a "cross-linked resin particle".

<Magnetic Toner>

A magnetic toner according to the present embodiment (may be simply referred to below as the toner) can be suitably used for developing for example an electrostatic latent image. The toner in the present embodiment may be used as a one-component developer. The toner according to the present embodiment is for example positively charged in a development device by friction with a development sleeve or a blade.

Toner particles included in the toner according to the present embodiment each include a toner mother particle and an external additive attached to the surface of the toner mother particle. The toner mother particles contain a binder resin and a magnetic powder. The external additive includes resin particles as external additive particles. A blocking rate of the resin particles after pressurization at a temperature of 160° C. and a pressure of 0.1 kgf/mm$^2$ for 5 minutes is no greater than 40% by mass as measured using a mesh having an opening of 75 μm. The resin particles have a number average primary particle diameter of at least 40 nm and no greater than 120 nm. A resin constituting the resin particles is a vinyl resin including a repeating unit represented by general formula (1) shown below, a repeating unit represented by general formula (2) shown below, and a repeating unit derived from a sulfo group-containing vinyl compound. The content of the repeating unit derived from the sulfo group-containing vinyl compound in the vinyl resin is at least 0.1 mol % and no greater than 3.5 mol % relative to all repeating units in the vinyl resin.

(1)

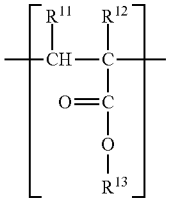

In general formula (1), $R^{11}$ and $R^{12}$ each represent, independently of each other, a hydrogen atom, a halogen atom, or an alkyl group having a carbon number of at least 1 and no greater than 6, and $R^{13}$ represents an alkyl group having a carbon number of at least 1 and no greater than 6.

(2)

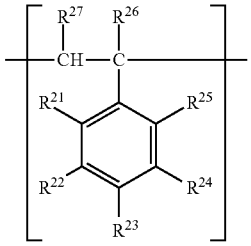

In general formula (2), $R^{21}$, $R^{22}$, $R^{23}$, $R^{24}$ and $R^{25}$ each represent, independently of one another, a hydrogen atom, a halogen atom, a hydroxy group, or an alkyl group having a carbon number of at least 1 and no greater than 6, and $R^{26}$ and $R^{27}$ each represent, independently of each other, a hydrogen atom, a halogen atom, or an alkyl group having a carbon number of at least 1 and no greater than 6.

The "blocking rate of the resin particles after pressurization at a temperature of 160° C. and a pressure of 0.1 kgf/mm$^2$ for 5 minutes as measured using a mesh having an opening of 75 μm" may be referred to below as a "blocking rate of the resin particles" or the "blocking rate". The method for measuring the blocking rate is the same method as that described below in association with Examples or a method conforming therewith.

The "vinyl resin including a repeating unit represented by general formula (1), a repeating unit represented by general formula (2), and a repeating unit derived from a sulfo group-containing vinyl compound" may be referred to below as a "specific vinyl resin". Also, the repeating unit represented by general formula (1) and the repeating unit represented by general formula (2) may be referred to as a "repeating unit (1)" and a "repeating unit (2)", respectively. Further, a repeating unit derived from a sulfo group-containing vinyl compound in the specific vinyl resin may be referred to as a "sulfo group-containing unit". The content of the sulfo group-containing unit relative to all repeating units in the specific vinyl resin (all repeating units derived from vinyl compounds in the specific vinyl resin) may be referred to as "sulfo group-containing unit content". The sulfo group-containing unit content can be determined by for example a solid-state nuclear magnetic resonance (NMR) measurement method.

With the toner according to the present embodiment, which has the above-described configuration, high-quality images can be continuously formed in both a normal-temperature and normal-humidity environment and a high-temperature and high-humidity environment. The reason is presumed as follows.

Generally, in a magnetic toner, magnetic particles having a relatively high surface hardness are present on the surfaces of toner mother particles. For this reason, when inorganic particles are used as external additive particles, the external additive particles (inorganic particles) tend to be easily detached from the toner mother particles due to contact between the toner particles in a development device. The detachment of the external additive particles due to contact between the toner particles is likely to occur particularly in a normal-temperature and normal-humidity environment. By contrast, resin particles generally have a relatively low surface hardness. For this reason, in a magnetic toner using resin particles as external additive particles, detachment of the external additive particles (resin particles) from the toner mother particles due to contact between the toner particles tends to be reduced. However, when the surface hardness of the resin particles is too low, the resin particles may adhere to for example a development sleeve in the development device, resulting in detachment of the resin particles from the toner mother particles. Further, in general, when the external additive particles have a small particle diameter (for example, when the number average primary particle diameter of the external additive particles is less than 40 nm), the external additive particles tend to be embedded in the toner mother particles especially in a high-temperature and high-humidity environment.

When at least one of detachment of the external additive particles from the toner mother particles and embedment of the external additive particles in the toner mother particles occurs, the external additive particles do not function as spacers between the toner mother particles. Accordingly, the amount of charge of the toner particles varies in the development device. As a result of the amount of charge of the toner particles varying, for example, deterioration in quality (more specifically, decrease in image density, fogging, or the like) may occur in a formed image.

In the toner according to the present embodiment, resin particles used as external additive particles (may be simply referred to below as "resin particles") have a blocking rate of no greater than 40% by mass, and therefore, have a relatively high surface hardness. Further, in the toner according to the present embodiment, the constituent resin of the resin particles is the specific vinyl resin having a sulfo group-containing unit content of at least 0.1 mol % and no greater than 3.5 mol %, and therefore, strength of electrostatic adhesion between the resin and the development sleeve can be reduced. From the above, in the toner according to the present embodiment, adhesion of the resin particles to the developing sleeve is inhibited.

Further, in the toner according to the present embodiment, the resin particles have a number average primary particle diameter of at least 40 nm, and therefore, embedment of the resin particles in the toner mother particles is inhibited even in a high-temperature and high-humidity environment. Further, in the toner according to the present embodiment, the resin particles have a number average primary particle diameter of no greater than 120 nm, and therefore, detachment of the resin particles from the toner mother particles due to contact between the toner particles is inhibited even in a normal-temperature and normal-humidity environment.

Therefore, with the toner according to the present embodiment, in which the function of the resin particles as spacers can be maintained in both a normal-temperature and normal-humidity environment and a high-temperature and high-humidity environment, high-quality images can be continuously formed.

"In both a normal-temperature and normal-humidity environment and a high-temperature and high-humidity environment" may be referred to below as "irrespective of environment".

In order to further suppress the detachment of the resin particles from the toner mother particles, the blocking rate of the resin particles in the present embodiment is preferably at least 10% by mass, more preferably at least 15% by mass, and more preferably at least 20% by mass.

In the present embodiment, in order to further inhibit adhesion of the resin particles to the development sleeve, the sulfo group-containing unit content is preferably at least 0.3 mol % and no greater than 3.3 mol %.

In order to continuously form further high quality images irrespective of environment, the amount of resin particles in the present embodiment is at least 0.1 parts by mass and no greater than 2.0 parts by mass relative to 100 parts by mass of the toner mother particles, and more preferably at least 0.5 part by mass and no greater than 2.0 parts by mass.

In the present embodiment, the toner particles may be toner particles each not including a shell layer or toner particles each including a shell layer (may be referred to below as capsule toner particles). In each capsule toner particle, the toner mother particle includes a toner core containing a binder resin and a magnetic powder and a shell layer covering a surface of the toner core. The shell layer contains a resin. For example, when low-melting toner cores are covered with shell layers having high heat resistance, heat-resistant preservability and low-temperature fixability of the toner can be both achieved. An additive may be dispersed in the resin constituting the shell layer. The shell layer may cover the entire surface of the toner core or partially cover the surface of the toner core.

In the present embodiment, the toner mother particles may contain, in addition to the binder resin and the magnetic powder, an internal additive other than the magnetic powder (at least one of a colorant, a releasing agent, and a charge control agent, for example) if necessary.

The following describes the toner according to the present embodiment in detail with reference to the accompanying drawing. The drawing schematically illustrates elements of configuration in order to facilitate understanding. Properties such as size and shape and the number of the elements of configuration illustrated in the drawing may differ from actual properties and the number thereof in order to facilitate preparation of the drawing.

[Structure of Toner Particles]

The following describes a structure of the toner particles included in the toner according to the present embodiment with reference to the drawing. FIGURE is a diagram illustrating an example of a cross-sectional structure of a toner particle included in the toner according to the present embodiment.

A toner particle 10 illustrated in FIGURE includes a toner mover particle 11 and an external additive attached to the surface of the toner mother particle 11. The toner mother particles 11 contain a binder resin and a magnetic powder. The external additive includes resin particles 12 as external additive particles.

A blocking rate of the resin particles 12 after pressurization at a temperature of 160° C. and a pressure of 0.1 kgf/mm$^2$ for 5 minutes is no greater than 40% by mass as measured using a mesh having an opening of 75 μm. The number average primary particle diameter of the resin particles 12 is at least 40 nm and no greater than 120 nm.

The resin constituting the resin particles 12 is the specific vinyl resin. The content of a repeating unit derived from the sulfo group-containing vinyl compound in the specific vinyl resin is at least 0.1 mol % and no greater than 3.5 mol % relative to all repeating units in the specific vinyl resin.

In order to obtain a toner suitable for image formation, the volume median diameter ($D_{50}$) of the toner mother particles 11 is preferably at least 4 μm and no greater than 9 μm.

An example of the structure of the toner particles included in the toner according to the present embodiment has been described so far with reference to FIGURE.

[Elements of Toner Particles]

The following describes elements of the toner particles included in the toner according to the present embodiment.

(Binder Resin)

The binder resin occupies for example at least 40% by mass of all components of the toner mother particles. Accordingly, properties of the binder resin are thought to have a great influence on overall properties of the toner mother particles. The properties (specific examples include acid value) of the binder resin can be adjusted through use of different resins in combination as the binder resin.

In order to impart excellent low-temperature fixability to the toner, the toner mother particles preferably contain a thermoplastic resin as the binder resin, and more preferably contain a thermoplastic resin in an amount of at least 85% by mass relative to a total amount of the binder resin. Examples of the thermoplastic resin include styrene-based resins, acrylic acid ester-based resins (specific examples include acrylic acid ester polymer and methacrylic acid ester polymer), olefin-based resins (specific examples include polyethylene resin and polypropylene resin), vinyl resins (specific examples include vinyl chloride resin, polyvinyl alcohol, vinyl ether resin, and N-vinyl resin), polyester resins, polyimide resins, and urethane resins. A copolymer of any of the above-listed resins, that is, a copolymer formed through introduction of a repeating unit into any of the above-listed resins (specific examples include styrene-acrylic acid-based resin and styrene-butadiene-based resin) can also be used as the binder resin.

A thermoplastic resin can be obtained through addition polymerization, copolymerization, or condensation polymerization of at least one thermoplastic monomer. Note that a thermoplastic monomer is a monomer that forms a thermoplastic resin through homopolymerization (specific examples include acrylic acid ester-based monomers and styrene-based monomers) or a monomer that forms a thermoplastic resin through condensation polymerization (for example, a combination of a polyhydric alcohol and a polybasic carboxylic acid that form a polyester resin through condensation polymerization).

In order to impart excellent low-temperature fixability to the toner, the binder resin is preferably a polyester resin.

A polyester resin can be obtained through condensation polymerization of at least one polyhydric alcohol and at least one polybasic carboxylic acid. Examples of polyhydric alcohols that can be used for synthesis of a polyester resin include dihydric alcohols (specific examples include aliphatic diols and bisphenols) and tri- or higher-hydric alcohols listed below. Examples of polybasic carboxylic acids that can be used for synthesis of a polyester resin include dibasic carboxylic acids and tri- or higher-basic carboxylic acids listed below. Note that a polybasic carboxylic acid derivative (specific examples include an anhydride of a polybasic carboxylic acid and a halide of a polybasic carboxylic acid) that can form an ester bond through condensation polymerization may be used instead of the polybasic carboxylic acid.

Examples of preferable aliphatic diols include diethylene glycol, triethylene neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid phthalic acid, isophthalic acid, terephthalic acid, cyclohexanedicarboxylic acid, adipic acid, sebacic acid, azelaic acid, malonic acid, 1,10-decanedicarboxylic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol trimer acid.

(Magnetic Powder)

The toner mother particles contain a magnetic powder. Magnetic particles contained in the magnetic powder contain for example a magnetic material as a main component. Examples of the magnetic material include ferromagnetic metals (specific examples include iron, cobalt, and nickel), alloys of ferromagnetic metals, ferromagnetic metal oxides (specific examples include ferrite, magnetite, and chromium dioxide), and materials subjected to ferromagnetization (specific examples include carbon materials rendered ferromagnetic through thermal treatment).

In order to continuously form further high quality images irrespective of environment, the magnetic particles are preferably particles containing magnetite as a main component, and more preferably particles constituted by magnetite magnetite particles). The magnetite particles may be treated with a surface treatment agent (for example a hydrophobization agent).

In order to form further high quality images irrespective of environment, the amount of the magnetic powder is preferably at least 50 parts by mass and no greater than 100 parts by mass relative to 100 parts by mass of the binder resin.

(Colorant)

The toner mother particles may contain a colorant. As the colorant, a black colorant can be used, for example. Carbon black can for example be used as the black colorant. In order to form further high quality images irrespective of environment, the amount of the colorant is preferably at least 1 part by mass and no greater than 20 parts by mass relative to 100 parts by mass of the binder resin.

The above-described magnetic powder may also be used as the black colorant. That is, the magnetic powder may have a function as a black colorant. In this case, in order to obtain a toner suitable for image formation, the content of the magnetic powder (a component having a function as a black colorant and a function as a magnetic material) is preferably at least 50 parts by mass and no greater than 100 parts by mass relative to 100 parts by mass of the binder resin.

(Releasing Agent)

The toner mother particles may contain a releasing agent. The releasing agent may be used in order to impart for example excellent offset resistance to the toner. The amount of the releasing agent is preferably at least 1 part by mass and no greater than 20 parts by mass relative to 100 parts by mass of the binder resin in order to impart excellent offset resistance to the toner.

Examples of the releasing agent include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of the ester waxes include natural ester waxes (specific examples include carnauba wax and rice wax) and synthetic ester waxes. In the present embodiment, one releasing agent may be used independently or two or more releasing agents may be used in combination.

(Charge Control Agent)

The toner mother particles may contain a charge control agent. The charge control agent is used in order to impart for example excellent charge stability or an excellent charge rise characteristic to the toner. The charge rise characteristic of a toner is an indicator as to whether or not the toner is chargeable to a specific charge level in a short period of time.

As a result of the toner mother particles containing a positively chargeable charge control agent, cationic strength (positive chargeability) of the toner mother particles can be increased. As a result of the toner mother particles containing a negatively chargeable charge control agent by contrast, anionic strength (negative chargeability) of the toner mother particles can be increased.

Examples of the positively chargeable charge control agent include: azine compounds such as pyridazine, pyrimidine, pyrazine, 1,2-oxazine, 1,3-oxazine, 1,4-oxazine, 1,2-thiazine, 1,4-thiazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC. Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; alkoxylated amine; alkylamide; quaternary ammonium salts such as benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt; and a resin having a quaternary ammonium cation group. One of the charge control agents listed above may be used independently, or two or more charge control agents listed above may be used in combination.

Examples of the negatively chargeable charge control agent include organic metal complexes, which are chelate compounds. A preferable organic metal complex is at least one selected from the group consisting of metal acetylacetonate complexes, salicylic acid-based metal complexes, and salts of them.

In order to impart excellent charge stability to the toner, the amount of the charge control agent is preferably at least 0.1 pails by mass and no greater than 20 parts by mass relative to 100 parts by mass of the binder resin.

(External Additive)

The toner particles included in the toner according to the present embodiment include an external additive attached to the surfaces of the toner mother particles.

The external additive includes resin particles as external additive particles. The constituent resin of the resin particles is the specific vinyl resin including a repeating unit represented by general formula (1), a repeating unit represented by general formula (2), and a sulfo group-containing unit. The specific vinyl resin may further include an additional repeating unit (for example, a crosslinking agent unit described later) in addition to the repeating unit (1), the repeating unit (2) and the sulfo group-containing unit.

In general formula (1). $R^{11}$ and $R^{12}$ preferably each represent, independently of each other, a hydrogen atom or a methyl group. In general formula (1), $R^{13}$ preferably represents an n-butyl group.

In general formula (2), $R^{21}$, $R^{22}$, $R^{23}$, $R^{24}$ and $R^{25}$ preferably each represent, independently of one another, a hydrogen atom or a halogen atom, and more preferably a hydrogen atom. In general formula (2), $R^{26}$ and $R^{27}$ preferably each represent, independently of each other, a hydrogen atom or a methyl group, and more preferably a hydrogen atom.

Examples of a monomer that provides the repeating unit (1) include methyl (meth)acrylate, ethyl (meth)acrylate, n-propyl (meth)acrylate, isopropyl (meth)acrylate, and n-butyl (meth)acrylate. In order to form a further high quality image irrespective of environment, the monomer that provides the repeating unit (1) is preferably n-butyl (meth) acrylate, and more preferably n-butyl methacrylate.

Examples of a monomer that provides the repeating unit (2) include styrene, α-methylstyrene, m-methylstyrene, p-methylstyrene, p-ethylstyrene, 4-t-butylstyrene, p-hydroxystyrene, m-hydroxy styrene, α-chlorostyrene, o-chlorostyrene, m-chlorostyrene, and p-chlorostyrene. In order to form a further high quality image irrespective of environment, the monomer that provides the repeating unit (2) is preferably styrene.

In order to form a further high quality image irrespective of environment, the molar ratio of the repeating unit (1) to the repeating unit (2) (repeating unit (1)/repeating unit (2)) in the specific vinyl resin is preferably at least 1 and no greater than 10.

In order to form a further high quality image irrespective of environment, the monomer that provides the sulfo group-containing unit (sulfo group-containing vinyl compound) is preferably a vinyl compound having one sulfo group or one sulfonate group. Specific examples of the sulfo group-containing vinyl compound include 2-acrylamido-2-methylpropanesulfonic acid, 2-acrylamido-2-methylpropanesulfonates, styrenesulfonic acid, styrenesulfonates, 2-(acryloyloxy)ethanesulfonic acid, 2-(acryloyoxy)ethanesulfonates, 2-(methacryloyloxy)ethanesulfonic acid, and 2-(methacryloyloxy)ethanesulfonates.

In order to further inhibit adhesion of the resin particles to the development sleeve, the sulfo group-containing vinyl compound is preferably 2-acrylamido-2-methylpropanesulfonic acid or a styrenesulfonate, and more preferably 2-acrylamido-2-methylpropanesulfonic acid. When a styrene sulfonate is used as the sulfo group-containing vinyl compound, sodium p-styrene sulfonate is preferable as the styrene sulfonate in order to further inhibit adhesion of the resin particles to the development sleeve.

When the monomer that provides the sulfo group-containing unit (sulfo group-containing vinyl compound) is 2-acrylamido-2-methylpropanesulfonic acid, the sulfo group-containing unit is represented by chemical formula (3) shown below.

(3)

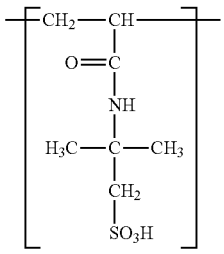

When the monomer that provides the sulfo group-containing unit (sulfo group-containing vinyl compound) is sodium p-styrene sulfonate, the sulfo group-containing unit is represented by chemical formula (4) shown below.

(4)

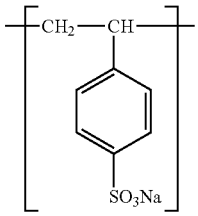

In order to facilitate adjustment of the blocking rate of the resin particles to within a range of no greater than 40% by mass, the specific vinyl resin as the constituent resin of the resin particles is preferably a cross-linked resin.

When the specific vinyl resin is a cross-linked resin, in order to facilitate adjustment of the blocking rate of the resin particles to within a range of no greater than 40% by mass, the specific vinyl resin preferably further includes a repeating unit derived from a crosslinking agent having two or more unsaturated bonds (for example, carbon-carbon double bonds), and more preferably further includes a repeating unit derived from a crosslinking agent having two carbon-carbon double bonds. The repeating unit derived from a crosslinking agent having two or more unsaturated bonds may be referred to below as a "crosslinking agent unit".

Examples of a crosslinking agent that provides the crosslinking agent unit include N,N'-methylenebisacrylamide, divinylbenzene, ethylene glycol diacrylate, ethylene glycol dimethacrylate, diethylene glycol diacrylate, tetraethylene glycol diacrylate, polyethylene glycol diacrylate, 1,4-butanedioldiacrylate, 1,6-hexanedioldiacrylate, tripropylene glycol diacrylate, trimethylolpropane triacrylate, pentaerythritol triacrylate, pentaerythritol tetraacrylate, 1,4-butanediol dimethacrylate, and 1,6-hexanediol dimethacrylate.

In order to further inhibit adhesion of the resin particles to the development sleeve, the crosslinking agent that provides the crosslinking agent unit is preferably divinylbenzene, and more preferably one or more selected from the group consisting of m-divinylbenzene and p-divinylbenzene.

In order to further inhibit detachment of the resin particles from the toner mother particles while further inhibiting adhesion of the resin particles to the development sleeve, the content of the crosslinking agent unit in the specific vinyl resin is preferably at least 20.0 mol % and no greater than 40.0 mol % relative to all repeating units in the specific vinyl resin. That is, as the resin particles having a blocking rate of no greater than 40% by mass, resin particles in which the content of the crosslinking agent unit in the specific vinyl resin is at least 20.0 mol % and no greater than 40.0 mol % relative to all repeating units in the specific vinyl resin is preferable. In order to further inhibit detachment of the resin particles from the toner mother particles while further inhibiting adhesion of the resin particles to the development sleeve, the content of the crosslinking agent unit in the specific vinyl resin is preferably at least 22.0 mol % and no greater than 38.0 mol % relative to all repeating units in the specific vinyl resin. The content of the crosslinking agent unit in the specific vinyl resin can be determined by for example a solid-state NMR measurement method. The blocking rate of the resin particles can be adjusted by changing the content of the crosslinking agent unit relative to all repeating units in the specific vinyl resin.

In order to further inhibit adhesion of the resin particles to the development sleeve, the resin particles preferably each include a resin base constituted by the specific vinyl resin and an anionic surfactant attached to a surface of the resin base. The resin particles each including a resin base constituted by the specific vinyl resin and an anionic surfactant attached to a surface of the resin base may be referred to below as specific anionic resin particles.

The following describes an example of a method for preparing the specific anionic resin particles of which the resin base is a cross-linked resin base. First, a monomer-containing liquid is prepared. The monomer-containing liquid contains water (more specifically, ion exchanged water or the like), a monomer that provides the repeating unit (1), a monomer that gives the repeating unit (2), a sulfo group-containing vinyl compound, a cross-linking agent having two or more unsaturated bonds, and an anionic surfactant. Subsequently, the monomer-containing liquid is stirred to cause polymerization reaction for forming the specific vinyl resin to proceed in the monomer-containing liquid. Then, the resultant product is taken out of the post-reaction liquid and is dried without washing (or alternatively, the product is washed under a condition that the anionic surfactant present on the surface of the product is not completely removed, and then is dried). By the method as described above, specific anionic resin particles each including a cross-linked resin base of which the constituent resin is the specific vinyl resin and an anionic surfactant attached to the surface of the cross-linked resin base can be obtained. The number average primary particle diameter of the specific anionic resin particles can be adjusted by for example changing at least one of the type of the anionic surfactant, the amount of the anionic surfactant, the stirring speed during polymerization (for example the rotational speed of a stirring impeller), and polymerization duration. In order to further inhibit adhesion of the resin particles to the development sleeve, the anionic surfactant is preferably dodecylbenzene sulfonate and more preferably sodium dodecylbenzene sulfonate.

In the method for preparing the specific anionic resin particles, when a cationic surfactant is used instead of the anionic surfactant, resin particles each including a cross-linked resin base and a cationic surfactant attached to the surface of the cross-linked resin base can be obtained. Also, in the method for preparing the specific anionic resin particles, by washing to completely remove the anionic surfactant present on the surface of the product after taking the product out of the post-reaction liquid, resin particles each constituted by only the cross-linked resin base (not including any anionic surfactant) can be obtained.

A preferable method for preparing resin particles usable for the toner according to the present embodiment has been described so far, but no particular limitations are placed on the method for preparing the resin particles. In the present embodiment, a commercially available product may be used as the resin particles.

The external additive may contain only the resin particles as external additive particles, or further contain additional external additive particles in addition to the resin particles. In order to favorably maintain fluidity of the toner, inorganic particles are preferable as the additional external additive particles. Examples of the inorganic particles include silica particles and particles of metal oxides (specific examples include titanic, alumina, magnesium oxide, and zinc oxide).

In order to secure an amount of charge suitable for image formation, silica particles are preferable as the additional external additive particles.

The additional external additive particles may have been subjected to surface treatment. For example, when silica particles are used as the additional external additive particles, surfaces of the silica particles may have hydrophobicity and/or positive chargeability imparted by a surface treatment agent. Examples of the surface treatment agent include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oil). The surface treatment agent is particularly preferably at least one selected from the group consisting of silane coupling agents and silazane compounds. Preferable examples of silane coupling agents include the silane compounds (specific examples include methyltrimethoxysilane and aminosilane). Preferable examples of the silazane compounds include hexamethyldisilazane (HMDS). When surfaces of silica bases (untreated silica particles) are treated with a surface treatment agent, part or all of a number of hydroxy groups (—OH) present on the surface of the silica base are replaced with functional groups derived from the surface treatment agent. As a result, obtained silica particles have functional groups derived from the surface treatment agent (specifically, functional groups having higher hydrophobicity and/or higher positive chargeability than the hydroxy groups) on the surfaces thereof.

In order to cause the external additive to sufficiently exert its function while inhibiting detachment of the external additive from the toner mother particles, the amount of the external additive particles (in a case where the additional external additive particles are used, the total amount of the resin particles and the additional external additives is preferably at least 0.1 parts by mass and no greater than 10 parts by mass relative to 100 parts by mass of the toner mother particles.

In order to form a high quality image irrespective of environment, the specific vinyl resin that constitutes the resin particles preferably satisfies the following condition 1, and more preferably satisfies the following condition 2.

Condition 1: The specific vinyl resin is a cross-linked resin including only a repeating unit derived from 2-acrylamido-2-methylpropanesulfonic acid or a styrenesulfonate, the repeating unit (1), the repeating unit (2), and a repeating unit derived from divinylbenzene as repeating units thereof.

Condition 2: The specific vinyl resin is a cross-linked resin including only a repeating unit derived from 2-acrylamido-2-methylpropanesulfonic acid or a styrenesulfonate, a repeating unit derived from n-butyl methacrylate, a repeating unit derived from styrene, and a repeating unit derived from divinylbenzene as repeating units thereof.

[Toner Production Method]

The following describes a suitable method for producing the toner according to the present embodiment.

(Preparation of Toner Mother Particles)

First, toner mother particles are prepared by an aggregation method or a pulverization method. The aggregation method includes an aggregation process and a coalescence process, for example. The aggregation process involves causing fine particles containing components constituting the toner mother particles to aggregate in an aqueous medium to form aggregated particles. The coalescence process involves causing the components contained in the aggregated particles to coalesce in the aqueous medium to form toner mother particles.

The following describes the pulverization method. The pulverization method can relatively easily prepare the toner mother particles and reduce manufacturing cost. In a case where the toner mother particles are prepared by the pulverization method, the toner mother particle preparation involves for example a melt-kneading process and a pulverization process. The toner mother particle preparation may further involve a mixing process before the melt-kneading process. The toner mother particle preparation process may further involve, after the pulverization process, at least one of a fine pulverization process and a classification process.

The mixing process involves mixing the binder resin, the magnetic powder, and an additional internal additive to be added depending on necessity thereof to yield a mixture. In the melt-kneading process, toner materials are melt-kneaded to yield a melt-kneaded product. The toner materials used in the melt-kneading process are for example the mixture yielded in the mixing process. In the pulverization process, the resultant melt-kneaded product is cooled for example to room temperature (25° C.) and then pulverized to yield a pulverized product. In a case where reduction in diameter of the pulverized product as a result of performance of the pulverization process is needed, a process of further pulverizing the pulverized product (fine pulverization process) may be performed. Further, in order to equalize the particle diameter of the pulverized product, a process of classifying the resultant pulverized product (classification process) may be performed. In the pulverizing process, the melt-kneaded product may be classified while being pulverized. Through the above processes, the toner mother particles that are the pulverized product are obtained.

(External Addition Process)

Thereafter, the resultant toner mother particles and an external additive are mixed together using a mixer to attach the external additive to the surfaces of the toner mother particles. The external additive contains at least resin particles. Through the above, a toner containing toner particles is produced.

EXAMPLES

The following describes examples of the present disclosure. However, the present disclosure is not limited to the scope of the examples. First, a method for measuring the blocking rate of resin particles will be described.

<Measurement Method of Blocking Rate>

As a jig for measurement, a device (product of KYOCERA Document Solutions Inc.) including a table (material: SUS304) with a cylindrical hole (diameter: 10 mm, depth: 10 mm), a cylindrical presser (diameter: 10 mm, material: SUS304), and a heater was used. SUS304 is an iron-chromium-nickel alloy (austenitic stainless steel) having a nickel content of 8% by mass and a chromium content of 18% by mass.

In the hole (measurement site) of the jig, 10 mg of a powder of resin particles (measurement target: one of resin particle powders PA-1 to PA-6 and PB-1 to PB-1 to PB-6 described later) was placed in an environment at a temperature of 23° C. and a relative humidity of 50%. Subsequently, the measurement site was heated to 160° C. with the heater of the jig, and a pressure of 0.1 kgf/mm$^2$ was applied to the measurement site (and thus the resin particles present in the measurement site) with the presser (load: 100 N) of the jig for 5 minutes. Thereafter, all of the resin particles in the measurement site (specifically, in the hole) were collected, and placed on a mesh having an opening of 75 μm and a known mass (a plain woven sieve having square openings defined in Japanese Industrial Standards (JWS) Z8801-1, 200 meshes, wire diameter: 50 μm). Then, the mass of the sieve including the resin particles was measured to determine the mass of the resin particles on the sieve (mass of the resin particles before suction).

Subsequently, the resin particles on the sieve were sucked from below the sieve using a suction machine ("V-3SDR", product of Amano Corporation). As a result of the suction, only the resin particles not blocked among the resin particles on the sieve passed through the sieve. After the suction, the mass of resin particles that did not pass through the sieve (resin particles remaining on the sieve) (the mass of resin particles after suction) was measured. The blocking rate (unit: % by mass) was calculated according to the following expression based on the mass of the resin particles before suction and the mass of the resin particles after suction.

Blocking rate=100×mass of resin particles after suction/mass of resin particles before suction <Preparation of Resin Particles>

The following describes methods for preparing resin particles PA-1 to PA-6 and PB-1 to PB-6.

[Preparation of Resin Particles]

A1-L four-necked flask equipped with a stirring impeller, a cooling tube, a thermometer, and a nitrogen inlet tube was charged with 600 g of ion exchanged water, 6 g of an anionic surfactant (sodium dodecylbenzenesulfonate), 100 g of n-butyl methacrylate, 20 g of styrene, 35 g divinylbenzene (mixture of m-divinylbenzene and p-divinylbenzene), 15 g of a polymerization initiator benzoyl peroxide), and 5 g of 2-acrylamido-2-methylpropanesulfonic acid under stirring at a rotational speed of 100 rpm.

Subsequently, nitrogen gas was introduced into the flask while the flask contents were stirred at a rotational speed of 100 rpm to change the internal atmosphere of the flask to a nitrogen atmosphere. The temperature of the flask contents was then increased to 90° C. in the nitrogen atmosphere while the flask contents were stirred at a rotational speed of 100 rpm. Thereafter, the flask contents were caused to react (specifically, polymerization reaction) for 3 hours under stirring at a rotational speed of 100 rpm in the nitrogen atmosphere at a temperature of 90° C. to yield an emulsion including a reaction product (resin particles). Next, the resultant emulsion was cooled for solid-liquid separation and the resultant solid was dried at a temperature of 80° C. for 18 hours to obtain a powder of resin particles PA-1.

The resin bases of the resin particles PA-1 were constituted by a resin (cross-linked resin) having a structure cross-linked by divinylbenzene as a cross-linking agent. That is, the resin particles PA-1 were cross-linked resin particles. The resin particles PA-1 each included a cross-linked resin base constituted by the specific vinyl resin and an anionic surfactant attached to the surface of the cross-linked resin base.

[Preparation of Resin Particles PA-2]

A powder of resin particles PA-2 was prepared by the same method as that for preparing the resin particles PA-1 in all aspects other than that the amount of divinylbenzene added into the flask was changed to 70 g and that the stirring speed of the flask contents (rotational speed of the stirring impeller) after raising the temperature of the flask contents to 90° C. was changed to 150 rpm.

The resin bases of the resin particles PA-2 were constituted by a resin (cross-linked resin) having a structure cross-linked by divinylbenzene as a cross-linking agent. That is, the resin particles PA-2 were cross-linked resin particles. The resin particles PA-2 each included a cross-linked resin base constituted by the specific vinyl resin and an anionic surfactant attached to the surface of the cross-linked resin base.

[Preparation of Resin Particles PA-3]

A powder of resin particles PA-3 was prepared by the same method as that for preparing the resin particles PA-1 in all aspects other than that the amount of divinylbenzene added into the flask was changed to 70 g and that the stirring speed of the flask contents (rotational speed of the stirring impeller) after raising the temperature of the flask contents to 90° C. was changed to 70 rpm.

The resin bases of the resin particles PA-3 were constituted by a resin (cross-linked resin) having a structure cross-linked by divinylbenzene as a cross-linking agent. That is, the resin particles PA-3 were cross-linked resin particles. The resin particles PA-3 each included a cross-linked resin base constituted by the specific vinyl resin and an anionic surfactant attached to the surface of the cross-linked resin base.

[Preparation of Resin Particles PA-4]

A powder of resin particles PA-4 was prepared by the same method as that for preparing the resin particles PA-1 in all aspects other than that the amount of divinylbenzene added into the flask was changed to 70 g and that the amount of 2-acrylamido-2-methylpropanesulfonic acid added into the flask was changed to 10 g.

The resin bases of the resin particles PA-4 were constituted by a resin (cross-linked resin) having a structure cross-linked by divinylbenzene as a cross-linking agent. That is, the resin particles PA-4 were cross-linked resin particles. The resin particles PA-4 each included a cross-linked resin base constituted by the specific vinyl resin and an anionic surfactant attached to the surface of the cross-linked resin base.

[Preparation of Resin Particles PA-5]

A powder of resin particles PA-5 was prepared by the same method as that for preparing the resin particles PA-1 in all aspects other than that the amount of divinylbenzene added into the flask was changed to 70 g and that the amount of 2-acrylamido-2-methylpropanesulfonic acid added into the flask was changed to 1 g.

The resin bases of the resin particles PA-5 were constituted by a resin (cross-linked resin) having a structure cross-linked by divinylbenzene as a cross-linking agent. That is, the resin particles PA-5 were cross-linked resin particles. The resin particles PA-5 each included a cross-linked resin base constituted by the specific vinyl resin and an anionic surfactant attached to the surface of the cross-linked resin base.

[Preparation of Resin Particles PA-6]

A powder of resin particles PA-6 was prepared by the same method as that for preparing the resin particles PA-1 in all aspects other than that the amount of divinylbenzene added into the flask was changed to 70 g and that 5 g of sodium p-styrene sulfonate was added into the flask instead of 5 g of 2-acrylamido-2-methylpropanesulfonic acid.

The resin bases of the resin particles PA-6 were constituted by a resin (cross-linked resin) having a structure cross-linked by divinylbenzene as a cross-linking agent. That is, the resin particles PA-6 were cross-linked resin particles. The resin particles PA-6 each included a cross-linked resin base constituted by the specific vinyl resin and an anionic surfactant attached to the surface of the cross-linked resin base.

[Preparation of Resin Particles PB-1]

A powder of resin particles PB-1 was prepared by the same method as that for preparing the resin particles PA-1 in all aspects other than that the amount of divinylbenzene added into the flask was changed to 20 g.

The resin bases of the resin particles PB-1 were constituted by a resin (cross-linked resin) having a structure cross-linked by divinylbenzene as a cross-linking agent. That is, the resin particles PB-1 were cross-linked resin particles. The resin particles PB-1 each included a cross-linked resin base constituted by the specific vinyl resin and an anionic surfactant attached to the surface of the cross-linked resin base.

[Preparation of Resin Particles PB-2]

A powder of resin particles PB-2 was prepared by the same method as that for preparing the resin particles PA-1 in all aspects other than that the amount of divinylbenzene added into the flask was changed to 70 g and that the stirring speed of the flask contents (rotational speed of the stirring impeller) after raising the temperature of the flask contents to 90° C. was changed to 200 rpm.

The resin bases of the resin particles PB-2 were constituted by a resin (cross-linked resin) having a structure cross-linked by divinylbenzene as a cross-linking agent. That is, the resin particles PB-2 were cross-linked resin particles. The resin particles PB-3 each included a cross-linked resin base constituted by the specific vinyl resin and an anionic surfactant attached to the surface of the cross-linked resin base.

[Preparation of Resin Particles PB-3]

A powder of resin particles PB-3 was prepared by the same method as that for preparing the resin particles PA-1 in all aspects other than that the amount of divinylbenzene added into the flask was changed to 70 g and that the stirring speed of the flask contents (rotational speed of the stirring impeller) after raising the temperature of the flask contents to 90° C. was changed to 50 rpm.

The resin bases of the resin particles PB-3 were constituted by a resin (cross-linked resin) having a structure cross-linked by divinylbenzene as a cross-linking agent. That is, the resin particles PB-3 were cross-linked resin particles. The resin particles PB-3 each included a cross-linked resin base constituted by the specific vinyl resin and an anionic surfactant attached to the surface of the cross-linked resin base.

[Preparation of Resin Particles PB-4]

A powder of resin particles PB-4 was prepared by the same method as that for preparing the resin particles PA-1 in all aspects other than that the amount of divinylbenzene added into the flask was changed to 70 g, that 6 g of a cationic surfactant ("QUARTAMIN (registered Japanese trademark) 24P", product of KAO Corporation) was added into the flask instead of 6 g of the anionic surfactant (sodium dodecylbenzenesulfonate), and that 2-acrylamido-2-methylpropanesulfonic acid was not added into the flask.

The resin bases of the resin particles PB-4 were constituted by a resin (cross-linked resin) having a structure cross-linked by divinylbenzene as a cross-linking agent. That is, the resin particles PB-4 were cross-linked resin particles. The resin particles PB-4 each included a cross-linked resin base and a cationic surfactant attached to the surface of the cross-linked resin base.

[Preparation of Resin Particles PB-5]

A powder of resin particles PB-5 was prepared by the same method as that for preparing the resin particles PA-1 in all aspects other than that the amount of divinylbenzene added into the flask was changed to 70 g and that the amount of 2-acrylamido-2-methylpropanesulfonic acid added into the flask was changed to 12 g.

The resin bases of the resin particles PB-5 were constituted by a resin (cross-linked resin) having a structure cross-linked by divinylbenzene as a cross-linking agent. That is, the resin particles PB-5 were cross-linked resin particles. The resin particles PB-5 each included a cross-linked resin base constituted by the specific vinyl resin and an anionic surfactant attached to the surface of the cross-linked resin base.

[Preparation of Resin Particles PB-6]

A powder of resin particles PB-6 was prepared by the same method as that for preparing the resin particles PA-1 in all aspects other than that the amount of divinylbenzene added into the flask was changed to 70 g and that 2-acrylamido-2-methylpropanesulfonic acid was not added into the flask.

The resin bases of the resin particles PB-6 were constituted by a resin (cross-linked resin) having a structure cross-linked by divinylbenzene as a cross-linking agent. That is, the resin particles PB-6 were cross-linked resin particles. The resin particles PB-6 each included a cross-linked resin base and an anionic surfactant attached to the surface of the cross-linked resin base.

Table 1 shows the content of a repeating unit derived from 2-acrylamido-2-methylpropanesulfonic acid (unit: mol %), the content of a repeating unit derived from sodium p-styrene sulfonate (unit: mol %), the content of a repeating unit derived from divinylbenzene (unit: mol %), the number average primary particle diameter (unit: nm), and the blocking rate (unit: % by mass) of each type of the obtained resin particles PA-1 to PA-6 and PB-1 to PB-6. In Table 1, "Content of AAPS unit" indicates the content of the repeating unit derived from 2-acrylamido-2-methylpropanesulfonic acid relative to all repeating units in the resin constituting the resin particles. In Table 1, "Content of SSNa unit" indicates the content of the repeating unit derived from sodium p-styrene sulfonate relative to all repeating units in the resin constituting the resin particles. In Table 1, "Content of DVB unit" indicates the content of the repeating unit derived from divinylbenzene relative to all repeating units in the resin constituting the resin particles. In Table 1, "Particle diameter" indicates a number average primary particle diameter.

Note that the same results were obtained when the number average primary particle diameter and the blocking rate of a powder of resin particles (one type of the resin particles PA-1 to PA-6 and PB-1 to PB-6) as a measurement target that have been separated from toner particles of a toner produced by a method described below were measured.

TABLE 1

| Resin particles | Content of AAPS unit [mol %] | Content of SSNa unit [mol %] | Content of DVB unit [mol %] | Particle diameter [nm] | Blocking rate [% by mass] |
|---|---|---|---|---|---|
| PA-1 | 2.0 | 0.0 | 22.6 | 70 | 40 |
| PA-2 | 1.7 | 0.0 | 36.9 | 40 | 20 |
| PA-3 | 1.7 | 0.0 | 36.9 | 120 | 20 |
| PA-4 | 3.3 | 0.0 | 36.3 | 70 | 23 |
| PA-5 | 0.3 | 0.0 | 37.4 | 70 | 20 |
| PA-6 | 0.0 | 1.7 | 36.9 | 70 | 20 |
| PB-1 | 2.2 | 0.0 | 14.3 | 70 | 45 |
| PB-2 | 1.7 | 0.0 | 36.9 | 30 | 20 |
| PB-3 | 1.7 | 0.0 | 36.9 | 140 | 20 |
| PB-4 | 0.0 | 0.0 | 37.5 | 70 | 20 |
| PB-5 | 3.9 | 0.0 | 36.1 | 70 | 20 |
| PB-6 | 0.0 | 0.0 | 37.5 | 70 | 20 |

<Production of Toner>

The following describes methods for producing toners TA-1 to TA-7 and TB-1 to TB-7.

[Production of Toner TA-1]

(Toner Mother Particle Preparation Process)

An FM mixer ("FM-20B", product of Nippon Coke & Engineering Co., Ltd.) was charged with 100 parts by mass of a polyester resin ("POLYESTER (registered Japanese trademark) HP-313", product of Nippon Synthetic Chemical Industry Co., Ltd.) as a binder resin, 70 parts by mass of magnetite particles ("TN-15", product of Mitsui Mining & Smelting Co., Ltd., average diameter by BET method: 0.17 μm), 2 parts by mass of a first positively chargeable charge control agent ("BONTRON (registered Japanese trademark) N-71", product of ORIENT CHEMICAL INDUSTRIES, Co., Ltd.), 4 parts by mass of a second positively chargeable charge control agent ("ACRYBASE (registered Japanese trademark) FCA-201-PS", product of FUJIKURA KASEI Co., Ltd), and 4 parts by mass of a carnauba wax (product of TOA KASEI Co., Ltd.) as a release agent, and these materials were mixed at a rotational speed of 200 rpm for 4 minutes.

Subsequently, the resulting mixture was melt-kneaded at a material feeding speed of 50 g/min, a shaft rotational speed of 100 rpm, and a cylinder temperature of 100° C. using a twin-screw extruder ("TEM-26SS", product of Toshiba Machine Co., Ltd.). The resulting melt-kneaded product was subsequently cooled. The resulting cooled melt-kneaded product was coarsely pulverized using a pulverizer ("ROTOPLEX (registered Japanese trademark), product of HOSOKAWA MICRON Corp.") at a set particle diameter of 2 mm. The resulting coarsely pulverized product was finely pulverized using a pulverizer ("TURBO MILL Type RS" product of FRET ND-TURBO Corp.). The resulting finely pulverized product was classified using a classifier ("ELBOW JET", product of NITTETSU MINING Co., Ltd.). Through the above, toner mother particles having a volume median diameter ($D_{50}$) of 7.0 μm were obtained.

(External Addition Process)

Subsequently, an FM mixer ("FM-10B", product of Nippon Coke & Engineering Co., Ltd.) was charged with 100 parts by mass of toner mother particles (the toner mother particles obtained through the above-described preparation process), 1.0 part by mass of hydrophobic silica particles ("AEROSIL (registered Japanese trademark) RA-200H", product of Nippon Aerosil Co., Ltd., number average primary particle diameter: 1), and 0.6 parts by mass of the resin particles PA-1, and these materials were mixed at a rotational speed of 3,500 rpm and a jacket temperature of 20° C. for 15 minutes. Through the above, all of the external additive particles (the hydrophobic silica particles and the resin particles PA-1) were attached to the surfaces of the toner mother particles.

Subsequently, the obtained powder was sieved using a 200-mesh sieve (opening: 75 μm) to obtain a toner TA-1 as a positively chargeable magnetic toner. Note that the composition ratio of the components constituting the toner TA-1 did not change between before and after the sieving.

[Production of Toners TA-2 to TA-7 and TB-1 to TB-7]

Toners TA-2 to TA-7 and TB-1 to TB-7 were produced by the same method as the production method of the toner TA-1 in all aspects other than that types and amounts of external additive particles added were as shown in Table 2, The toners TA-2 to TA-7 and TB-1 to TB-7 were all positively chargeable magnetic toners. In Table 2, "RA-200H" indicates hydrophobic silica particles ("AEROSIL (registered Japanese trademark) RA-200H", product of Nippon Aerosil Co., Ltd., number average primary particle diameter: 12 nm). In Table 2, "NA50H" indicates hydrophobic silica particles ("AEROSIL (registered Japanese trademark) NA50H", product of Nippon Aerosil Co., Ltd., number average primary particle diameter: 40 nm). In Table 2, "Amount added" indicates an amount of added external additive particles (either resin particles or silica particles, unit: parts by mass) relative to 100 parts by mass of the toner mother particles. In Table 2, "-" in the column of "Resin particles" means that no resin particles were used as the external additive particles. In Table 2, "-" in the column of "Silica particles" means that no silica particles were used as the external additive particles.

TABLE 2

| | External additive particles | | | |
|---|---|---|---|---|
| | Resin particles | | Silica particles | |
| Toner | Type | Amount added [parts by mass] | Type | Amount added [parts by mass] |
| TA-1 | PA-1 | 0.6 | RA-200H | 1.0 |
| TA-2 | PA-2 | 0.6 | RA-200H | 1.0 |
| TA-3 | PA-3 | 0.6 | RA-200H | 1.0 |
| TA-4 | PA-4 | 0.6 | RA-200H | 1.0 |
| TA-5 | PA-5 | 0.6 | RA-200H | 1.0 |
| TA-6 | PA-6 | 0.6 | RA-200H | 1.0 |
| TA-7 | PA-2 | 1.6 | — | — |
| TB-1 | PB-1 | 0.6 | RA-200H | 1.0 |
| TB-2 | PB-2 | 0.6 | RA-200H | 1.0 |
| TB-3 | PB-3 | 0.6 | RA-200H | 1.0 |
| TB-4 | PB-4 | 0.6 | RA-200H | 1.0 |
| TB-5 | PB-5 | 0.6 | RA-200H | 1.0 |
| TB-6 | PB-6 | 0.6 | RA-200H | 1.0 |
| TB-7 | — | — | NA50H | 1.6 |

<Evaluation Method>

The following describes a method for evaluating the toners TA-1 to TA-7 and TB-1 to TB-7.

[Image Density and Fogging Density in Normal-temperature and Normal-humidity Environment]

A monochrome printer ("ECOSYS (registered Japanese trademark) LS-4200DN", product of KYOCERA Document Solutions Inc., surface layer of development sleeve: Ni—Cr plating layer) was used as an evaluation apparatus. The development device and the toner container of the evaluation apparatus were charged with a toner (evaluation target: one of the toners TA-1 to TA-7 and TB-1 to TB-7). Subsequently, using the evaluation apparatus, a printing durability test of continuously printing an image having a coverage rate of 30% on 50,000 sheets of printing paper (A4-size plain paper) was performed in a normal-temperature and normal-humidity environment at a temperature 23° C. and a relative humidity of 50%.

In the above-described durability test, an image density (ID) and a fogging density (FD) were measured at each timing of before printing of the image having a coverage rate of 30% (referred to below as "initial") and after printing of the image having a coverage rate of 30% on 50,000 sheets (referred to below as "after printing 50,000 sheets"). Specifically, at each timing of initial and after printing on 50,000 sheets, a solid image having a size of 25 mm×25 mm was formed on a sheet of printing paper (A4-size printing paper) using the above-described evaluation apparatus in a normal-temperature and normal-humidity environment at a temperature 23° C. and a relative humidity of 50%. An image density (ID) of the solid image formed on the printing paper was measured using a reflection densitometer ("RD914", product of X-Rite, Inc.). An image density (ID) after printing 50,000 sheets of at least 1.300 was evaluated as "decrease in image density was particularly suppressed", and an image density (ID) after printing 50,000 sheets of at least 1.200 and less than 1.300, was evaluated as "decrease in image density was suppressed". In addition, an image density (ID) after printing 50,000 sheets of less than 1.200, was evaluated as "decrease in image density was not suppressed".

Further, an image density (ID) of a blank portion of the printing paper with the solid image formed thereon was measured using the reflection densitometer ("RD914", product of X-Rite, Inc.), and a fogging density (FD) was calculated based on the expression (A) shown below. A fogging density (FD) after printing 50,000 sheets of no greater than 0.003 was evaluated as "fogging was particularly inhibited", and a fogging density (FD) after printing 50,000 sheets of greater than 0.003 and no greater than 0.007 was evaluated as "fogging was inhibited". In addition, a fogging density (FD) after printing 50,000 sheets of greater than 0.007 was evaluated as "fogging was not inhibited".

$$\text{Fogging density (FD)} = \text{image density of blank portion} - \text{image density (ID) of unprinted paper} \quad (A)$$

[Image Density and Fogging Density in High-temperature and High-humidity Environment]

A monochrome printer ("ECOSYS (registered Japanese trademark') LS-4200DN", product of KYOCERA Document Solutions Inc., surface layer of development sleeve: Ni—Cr plating layer) was used as an evaluation apparatus. The development device and the toner container of the evaluation apparatus were charged with a toner (evaluation target: one of the toners TA-1 to TA-7 and TB-1 to TB-7). Subsequently, using the evaluation apparatus in a high-temperature and high-humidity environment at a temperature 32.5° C. and a relative humidity of 80%, a printing durability test of continuously printing an image having a coverage rate of 1% on 50,000 sheets of printing paper (A4-size plain paper) was performed.

In the above-described durability test, an image density (ID) and a fogging density (FD) were measured at each timing of before printing of the image having a coverage rate of 1% (referred to below as "initial") and after printing of the image having a coverage rate of 1% on 50,000 sheets (referred to below as "after printing on 50,000 sheets"). Specifically, at each timing of initial and after printing on 50,000 sheets, a solid image having a size of 25 mm×25 mm was formed on a sheet of printing paper (A4-size printing paper) using the above-described evaluation apparatus in a high-temperature and high-humidity environment at a temperature 32.5° C. and a relative humidity of 80%. An image density (ID) of the solid image formed on the printing paper was measured using a reflection densitometer ("RD914", product of X-Rite, Inc.). An image density (ID) after printing 50,000 sheets of at least 1.300 was evaluated as "decrease in image density was particularly suppressed", and an image density (ID) after printing 50,000 sheets of at least 1.200 and less than 1.300 was evaluated as "decrease in image density was suppressed". In addition, an image density (ID) after printing 50,000 sheets of less than 1.200 was evaluated as "decrease in image density was not suppressed".

Using the printing paper having the solid image formed thereon, a fogging density (FD) in a high-temperature and high-humidity environment was determined by the same method as that for determining the fogging density (FD) in [Image Density and Fogging Density in Normal-temperature and Normal-humidity Environment] described above. A fogging density (FD) after printing 50,000 sheets of no greater than 0.003 was evaluated as "fogging was particularly inhibited", and a fogging density (FD) after printing 50,000 sheets of greater than 0.003 and no greater than 0.007 was evaluated as "fogging was inhibited". In addition, a fogging density (FD) after printing 50,000 sheets of greater than 0.007 was evaluated as "fogging was not inhibited".

<Evaluation Results>

Table 3 shows evaluation results of image density (ID) (initial and after printing 50,000 sheets) of the solid image in the normal-temperature and normal-humidity environment and fogging density (FD) (initial and after printing 50,000 sheets) in the normal-temperature and normal-humidity environment for each of the toners TA-1 to TA-7 and TB-1 to TB-7. Also, Table 4 shows evaluation results of image density (ID) (initial and after printing 50,000 sheets) of the solid image in the high-temperature and high-humidity environment and fogging density (FD) (initial and after printing 50,000 sheets) in the high-temperature and high-humidity environment for each of the toners TA-1 to TA-7 and TB-1 to TB-7.

TABLE 3

| | | In normal-temperature and normal-humidity environment | | | |
|---|---|---|---|---|---|
| | | Initial | | After printing 50,000 sheets | |
| | Toner | ID | FD | ID | FD |
| Example 1 | TA-1 | 1.423 | 0.002 | 1.402 | 0.003 |
| Example 2 | TA-2 | 1.433 | 0.002 | 1.412 | 0.003 |
| Example 3 | TA-3 | 1.398 | 0.002 | 1.345 | 0.003 |
| Example 4 | TA-4 | 1.378 | 0.002 | 1.298 | 0.006 |
| Example 5 | TA-5 | 1.412 | 0.002 | 1.289 | 0.007 |
| Example 6 | TA-6 | 1.423 | 0.002 | 1.364 | 0.005 |
| Example 7 | TA-7 | 1.312 | 0.002 | 1.305 | 0.003 |
| Comparative Example 1 | TB-1 | 1.422 | 0.002 | 1.401 | 0.003 |
| Comparative Example 2 | TB-2 | 1.423 | 0.002 | 1.414 | 0.003 |
| Comparative Example 3 | TB-3 | 1.320 | 0.002 | 1.1.50 | 0.009 |
| Comparative Example 4 | TB-4 | 1.422 | 0.002 | 1.178 | 0.009 |
| Comparative Example 5 | TB-5 | 1.345 | 0.002 | 1.198 | 0.008 |
| Comparative Example 6 | TB-6 | 1.421 | 0.002 | 1.198 | 0.008 |
| Comparative Example 7 | TB-7 | 1.432 | 0.001 | 1.185 | 0.009 |

TABLE 4

| | | In high-temperature and high-humidity environment | | | |
|---|---|---|---|---|---|
| | | Initial | | After printing 50,000 sheets | |
| | Toner | ID | FD | ID | FD |
| Example 1 | TA-1 | 1.345 | 0.001 | 1.276 | 0.002 |
| Example 2 | TA-2 | 1.356 | 0.001 | 1.290 | 0.002 |
| Example 3 | TA-3 | 1.345 | 0.001 | 1.324 | 0.001 |
| Example 4 | TA-4 | 1.302 | 0.001 | 1.275 | 0.001 |
| Example 5 | TA-5 | 1.355 | 0.001 | 1.325 | 0.001 |
| Example 6 | TA-6 | 1.362 | 0.001 | 1.352 | 0.001 |
| Example 7 | TA-7 | 1.325 | 0.001 | 1.315 | 0.001 |
| Comparative Example 1 | TB-1 | 1.344 | 0.001 | 1.189 | 0.005 |
| Comparative Example 2 | TB-2 | 1.358 | 0.001 | 1.198 | 0.002 |
| Comparative Example 3 | TB-3 | 1.278 | 0.001 | 1.193 | 0.004 |
| Comparative Example 4 | TB-4 | 1.355 | 0.001 | 1.312 | 0.003 |
| Comparative Example 5 | TB-5 | 1.298 | 0.001 | 1.186 | 0.004 |
| Comparative Example 6 | TB-6 | 1.324 | 0.001 | 1.290 | 0.002 |
| Comparative Example 7 | TB-7 | 1.356 | 0.001 | 1.289 | 0.003 |

In each of the toners TA-1 to TA-7, the toner particles each included a toner mother particle containing a binder resin and a magnetic powder, and an external additive attached to a surface of the toner mother particle. In each of the toners TA-1 to TA-7, the external additive included resin particles as external additive particles. In each of the toners TA-1 to TA-7, the constituent resin of the resin particles was the specific vinyl resin. In each of the toners TA-1 to TA-7, the blocking rate of the resin particles was no greater than 40% by mass. In each of the toners TA-1 to TA-7, the number average primary particle diameter of the resin particles was at least 40 nm and no greater than 120 nm. In each of the toners TA-1 to TA-7, the sulfa group-containing unit content was at least 0.1 mol % and no greater than 3.5 mol %.

As shown in Table 3, use of any of the toners TA-1 to TA-3, TA-6, and TA-7 resulted in an image density (ID) of at least 1.300 after printing 50,000 sheets in the normal-temperature and normal-humidity environment. Thus, use of any of the toners TA-1 to TA-3, TA-6, and TA-7 particularly suppressed decrease in image density in the normal-temperature and normal-humidity environment. Use of either of the toners TA-4 and TA-7 resulted in an image density (ID) of at least 1.200 and less than 1.300 after printing 50,000 sheets in the normal-temperature and normal-humidity environment. Thus, use of either of the toners TA-4 and TA-5 suppressed decrease in image density in the normal-temperature and normal-humidity environment. Use of any of the toners TA-1 to TA-3 and TA-7 resulted in a fogging density (FD) of no greater than 0.003 after printing 50,000 sheets in the normal-temperature and normal-humidity environment. Thus, use of any of the toners TA-1 to TA-3 and TA-7 particularly inhibited fogging in the normal-temperature and normal-humidity environment. Use of any of the toners TA-4 to TA-6 resulted in a fogging density (FD) of greater than 0.003 and no greater than 0.007 after printing 50,000 sheets in the normal-temperature and normal-humidity environment. Thus, use of any of the toners TA-4 to TA-6 suppressed fogging in the normal-temperature and normal-humidity environment.

As shown in Table 4, use of any of the toners TA-3 and TA-5 to TA-7 resulted in an image density (ID) of at least 1.300 after printing 50,000 sheets in the high-temperature and high-humidity environment. Thus, use of any of the toners TA-3 and TA-5 to TA-7 particularly suppressed decrease in image density in the high-temperature and high-humidity environment. Use of any of the toilers TA-1, TA-2, and TA-4 resulted in an image density (ID) of at least 1.200 and less than 1.300 after printing 50,000 sheets in the high-temperature and high-humidity environment. Thus, use of any of the toners TA-1, TA-2, and TA-4 suppressed decrease in image density in the high-temperature and high-humidity environment. Use of any of the toners TA-1 to TA-7 resulted in a fogging density (FD) of no greater than 0.003 after printing 50,000 sheets in the high-temperature and high-humidity environment. Thus, use of any of the toners TA-1 to TA-7 particularly inhibited fogging in the high-temperature and high-humidity environment.

In the toner TB-1, the blocking rate of the resin particles was greater than 40% by mass. In the toner TB-2, the number average primary particle diameter of the resin particles was less than 40 nm. In the toner TB-3, the number average primary particle diameter of the resin particles was greater than 120 nm. In each of the toners TB-4 and TB-6, the sulfo group-containing unit content was less than 0.1 mol %. In the toner TB-5, the sulfo group-containing unit content was greater than 3.5 mol %. In the toner TB-7, the external additive did not include resin particles as external additive particles.

As shown in Table 3, use of any of the toners TB-3 to TB-7 resulted in an image density (ID) of less than 1.200 after printing 50,000 sheets in the normal-temperature and normal-humidity environment. Thus, use of any of the toners TB-3 to TB-7 did not suppress decrease in image density in the normal-temperature and normal-humidity environment. Use of any of the toners TB-3 to TB-7 resulted in a fogging density (FD) of greater than 0.007 after printing 50,000 sheets in the normal-temperature and normal-humidity environment. Thus, use of any of the toners TB-3 to TB-7 did not inhibit fogging in the normal-temperature and normal-humidity environment.

As shown in Table 4, use of any of the toners TB-1 to TB-3 and TB-5 resulted in an image density (ID) of less than 1.200 after printing 50,000 sheets in the high-temperature and high-humidity environment. Thus, use of any of the toners TB-1 to TB-3 and TB-5 did not suppress decrease in image density in the high-temperature and high-humidity environment.

The above results showed that with use of the magnetic toner according to the present disclosure, high-quality images can be continuously formed in both the normal-temperature and normal-humidity environment and the high-temperature and high-humidity environment.

What is claimed is:

1. A magnetic toner comprising toner particles, wherein the toner particles each include a toner mother particle and an external additive attached to a surface of the toner mother particle, the toner mother particles contain a binder resin and a magnetic powder, the external additive includes resin particles as external additive particles, a blocking rate of the resin particles after pressurization at a temperature of 160° C. and a pressure of 0.1 kgf/mm$^2$ for 5 minutes is no greater than 40% by mass as measured using a mesh having an opening of 75 μm, the resin particles have a number average primary particle diameter of at least 40 nm and no greater than 120 nm, a resin constituting the resin particles is a vinyl resin including a repeating unit represented by general formula (1) shown below, a repeating unit represented by general formula (2) shown below, and a repeating unit derived from a sulfo group-containing vinyl compound, and a content of the repeating unit derived from the sulfo group-containing vinyl compound in the vinyl resin is at least 0.1 mol % and no greater than 3.5 mol % relative to all repeating units in the vinyl resin, (1)

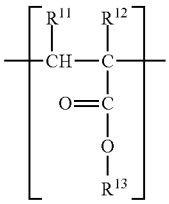

where in the general formula (1), $R^{11}$ and $R^{12}$ each represent, independently of each other, a hydrogen atom, a halogen atom, or an alkyl group having a carbon number of at least 1 and no greater than 6, and $R^{13}$ represents an alkyl group having a carbon number of at least 1 and no greater than 6, (2)

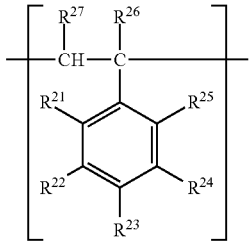

where in the general formula (2), $R^{21}$, $R^{22}$, $R^{23}$, $R^{24}$ and $R^{25}$ each represent, independently of one another, a hydrogen atom, a halogen atom, a hydroxy group, or an alkyl group having a carbon number of at least 1 and no greater than 6, and $R^{26}$ and $R^{27}$ each represent, independently of each other, a hydrogen atom, a halogen atom, or an alkyl group having a carbon number of at least 1 and no greater than 6.

2. The magnetic toner according to claim 1, wherein the resin particles each include a resin base constituted by the vinyl resin and an anionic surfactant attached to a surface of the resin base.

3. The magnetic toner according to claim 1, wherein the vinyl resin is a cross-linked resin.

4. The magnetic toner according to claim 3, wherein the vinyl resin further include a repeating unit derived from a crosslinking agent having two or more unsaturated bonds.

5. The magnetic toner according to claim 4, wherein a content of the repeating unit derived from a crosslinking agent having two or more unsaturated bonds in the vinyl resin is at least 20.0 mol % and no greater than 40.0 mol % relative to all repeating units in the vinyl resin.

6. The magnetic toner according to claim 4, wherein the crosslinking agent having two or more unsaturated bonds is divinylbenzene.

7. The magnetic toner according to claim 1, wherein the blocking rate of the resin particles is greater than 10% by mass as measured using a mesh having an opening of 75 μm.

8. The magnetic toner according to claim 1, wherein an amount of the resin particles is at least 0.1 parts by mass and no greater than 2.0 parts by mass relative to 100 parts by mass of the toner mother particles.

9. The magnetic toner according to claim 1, wherein the sulfo group-containing vinyl compound is 2-acrylamido-2-methylpropanesulfonic acid or a styrenesulfonate.

* * * * *